US009599066B2

(12) United States Patent
Burns

(10) Patent No.: US 9,599,066 B2
(45) Date of Patent: Mar. 21, 2017

(54) CARBURETOR WITH LOW FLOW RATE FLUID PASSAGE

(71) Applicant: WALBRO ENGINE MANAGEMENT, L.L.C., Tucson, AZ (US)

(72) Inventor: Michael P. Burns, Millington, MI (US)

(73) Assignee: WALBRO LLC, Tucson, AZ (US)

( * ) Notice: Subject to any disclaimer, the term of this patent is extended or adjusted under 35 U.S.C. 154(b) by 117 days.

(21) Appl. No.: 14/628,326

(22) Filed: Feb. 23, 2015

(65) Prior Publication Data

US 2015/0247476 A1 Sep. 3, 2015

Related U.S. Application Data

(60) Provisional application No. 61/945,847, filed on Feb. 28, 2014.

(51) Int. Cl.

| | |
|---|---|
| ***F02M 7/08*** | (2006.01) |
| ***F02M 1/16*** | (2006.01) |
| ***B01F 3/04*** | (2006.01) |
| ***F02M 17/04*** | (2006.01) |

(52) U.S. Cl.

CPC ..... *F02M 1/16* (2013.01); *B01F 3/04* (2013.01); *B01F 3/04056* (2013.01); *F02M 7/08* (2013.01); *F02M 17/04* (2013.01)

(58) Field of Classification Search

CPC .... B01F 3/04; B01F 3/04007; B01F 3/04021; F02M 7/08; F02M 1/16; F02M 39/00

USPC ..... 261/34.1, 34.2, 38, 76, 64.1, DIG. 8, 261/DIG. 21, 36.2

See application file for complete search history.

(56) References Cited

U.S. PATENT DOCUMENTS

| | | | | |
|---|---|---|---|---|
| 7,467,785 | B2 | 12/2008 | Braun | |
| 7,690,342 | B2 | 4/2010 | Gliniecki et al. | |
| 9,062,630 | B2 * | 6/2015 | Kus | F02M 1/18 |

OTHER PUBLICATIONS

STANADYNE; Operation Manual Model DB4 Pump; Dec. 2012, 52 pages.

* cited by examiner

*Primary Examiner* — Robert A Hopkins

(74) *Attorney, Agent, or Firm* — Reising Ethington P.C.

(57) ABSTRACT

A carburetor including a body having a main bore through which a fuel and air mixture is discharged from the carburetor for use by an engine a priming passage communicated with the main bore, a pump that moves fluid into the priming passage, and a flow restrictor received within at least a portion of the priming passage to reduce the minimum effective flow area of the priming passage. The flow restrictor has a body received at least partially within the priming passage so that fluid flows around the flow restrictor and between the structure defining the priming passage and the flow restrictor.

19 Claims, 5 Drawing Sheets

CARBURETOR WITH LOW FLOW RATE FLUID PASSAGE

REFERENCE TO CO-PENDING APPLICATION

This application claims the benefit of U.S. Provisional Application No. 61/945,847 filed Feb. 28, 2014, which is incorporated herein by reference in its entirety.

TECHNICAL FIELD

The present disclosure relates generally to a carburetor for providing a fuel and air mixture to an engine.

BACKGROUND

Carburetors are devices that can be used to mix fuel with air to power combustion engines. A carburetor may include a fuel metering system that helps control the amount of fuel supplied to air flowing through the carburetor to provide a desired fuel to air ratio of the fuel and air mixture delivered from the carburetor. The size of at least certain fluid passages in the carburetor may be limited, at least in the manner in which they may be economically manufactured. For example, it can be difficult to accurately and economically form a small diameter passage in a metal carburetor body.

SUMMARY

A carburetor including a body having a main bore through which a fuel and air mixture is discharged from the carburetor for use by an engine a priming passage communicated with the main bore, a pump that moves fluid into the priming passage, and a flow restrictor received within at least a portion of the priming passage to reduce the minimum effective flow area of the priming passage. The flow restrictor has a body received at least partially within the priming passage so that fluid flows around the flow restrictor and between the structure defining the priming passage and the flow restrictor.

In at least some implementations, the flow restrictor defines the maximum restriction to flow in the priming passage and the flow restrictor has a length to thickness ratio of at least 4, and may have a length to perimeter ratio of at least 2. Also in at least some implementations, the flow restrictor may be defined by a wire. In at least some implementations, the priming passage is at least 0.4 mm in diameter and the total flow area between the flow restrictor and the priming passage is less than 0.12 $mm^2$, and may be less than 0.08 $mm^2$. The priming passage may have a reduced diameter section and the flow restrictor may extend completely through the reduced diameter section. The carburetor may include at least one passage intersecting with the priming passage and providing access to an end of the flow restrictor so that the end of the flow restrictor may be deformed to inhibit unintended removal of the flow restrictor. Also, the passage intersecting with the priming passage may be the main bore and a portion of the flow restrictor may extend into the main bore.

A carburetor may include a body having a main bore through which air flows and into which fuel is admitted to provide a fuel and air mixture to an engine, a passage through which fluid flows, and a flow restrictor provided through at least a portion of the passage to reduce the minimum effective flow area of the passage, the flow restrictor comprising a body received at least partially within the passage so that fluid flows around the flow restrictor and between the portion of the body defining the passage and the flow restrictor, the priming passage is at least 0.4 mm in diameter and the total flow area between the flow restrictor and the priming passage is less than 0.12 $mm^2$. Air and/or fuel may flow through the passage. The passage may instead or also define a fuel nozzle of the carburetor that opens into the main bore to provide fuel into the main bore. And the flow restrictor may be defined by a wire extending into the passage.

It is contemplated that the various features set forth in the preceding paragraphs, in the claims and/or in the following description and drawings may be taken independently or in any combination thereof. For example, features disclosed in connection with one embodiment are applicable to all embodiments, except where there is incompatibility of features.

BRIEF DESCRIPTION OF THE DRAWINGS

The following detailed description of certain embodiments and best mode will be set forth with reference to the accompanying drawings, in which.

DETAILED DESCRIPTION OF PREFERRED EMBODIMENTS

Figure 2:
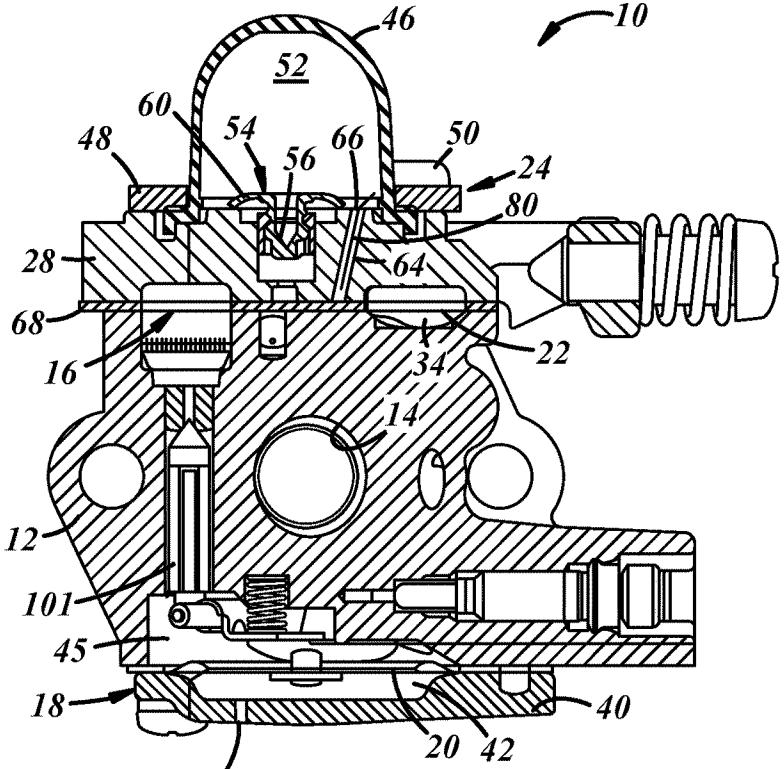
FIG. 2 is a sectional view of the carburetor of FIG. 1.
Figure 1:
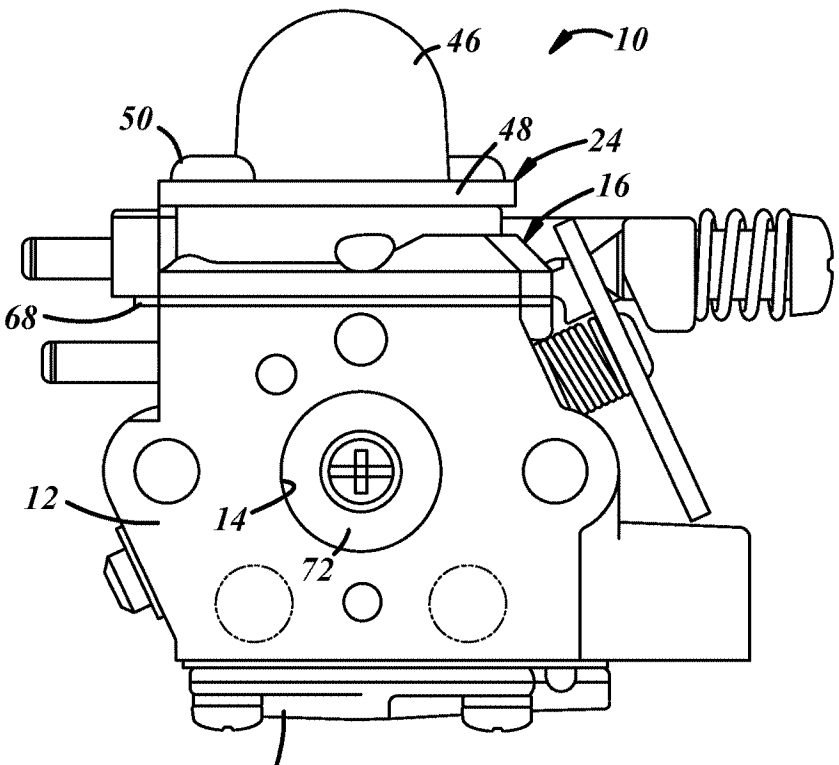
FIG. 1 is a side view of a diaphragm-type carburetor including a purge/prime assembly.
Figure 3:
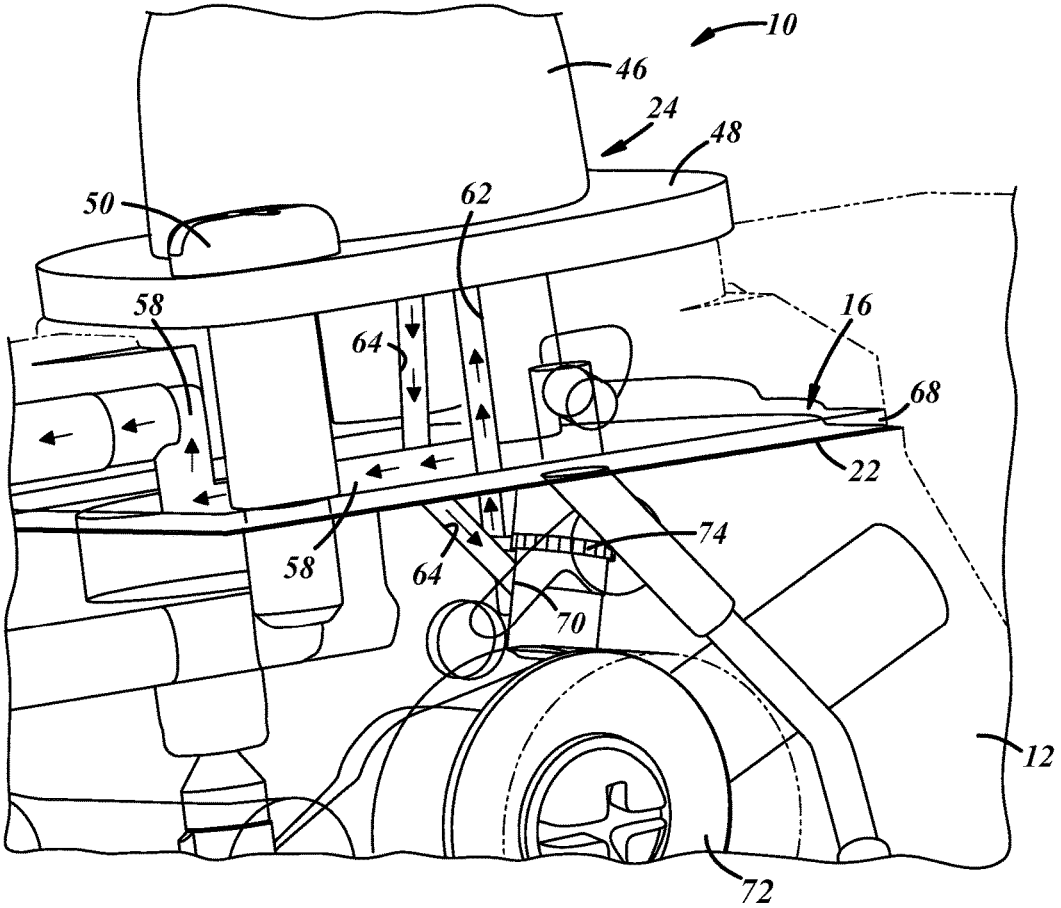
FIG. 3 is an enlarged, fragmentary view of the carburetor showing a purge and prime assembly including an internal priming passage and purge passages of the carburetor.

Referring in more detail to the drawings, FIGS. 1-3 illustrate a carburetor 10 that provides a fuel and air mixture to an engine to support operation of the engine. The carburetor 10 has a main body 12 (typically cast metal) with a main bore 14 through which air flows from an air cleaner to an engine intake. The carburetor 10 also has a fuel circuit through which fuel is provided into the main bore 14 and combined with the air flow to form the fuel and air mixture. The fuel circuit includes a fuel pump assembly 16 and a fuel metering assembly 18. The fuel metering assembly 18 includes a diaphragm 20 (FIG. 2) that controls the rate at which fuel is delivered into the main bore 14 in accordance with a pressure differential across the metering diaphragm 20. The fuel pump assembly 16 includes a diaphragm 22 that is driven to take in fuel from a fuel source and discharge fuel to the fuel metering assembly 18. To facilitate starting the engine, the fuel circuit may also have a purge and prime circuit 24 through which stale fuel and vapors may be removed from the carburetor 10 as fresh fuel is drawn into the carburetor before starting an engine. At the same time, a metered amount of fuel may be discharged into or made available to the main bore to facilitate starting and/or initial warming up of the engine.

As shown in FIGS. 2 and 3, the fuel pump assembly 16 may include a fuel pump body 28 that defines part of the fuel pump assembly, including fuel flow paths for the fuel pump assembly, and traps the fuel pump diaphragm 22 against the carburetor main body 12. The fuel metering assembly 18 may include a fuel metering body 40 that traps the fuel metering diaphragm 20 against the carburetor main body 12 and, with the fuel metering diaphragm 20, defines a reference chamber 42 that may be at atmospheric pressure due to a vent 44 formed in the body 40. A fuel metering chamber 45 is defined on the opposite side of the fuel metering diaphragm from the reference chamber and fuel is provided to the main bore 14 from the fuel metering chamber 45 in normal operation of the carburetor 10 and engine. The general constructions and functions of the fuel pump assembly 16 and the fuel metering assembly 18 are known in the art and will not be described further.

The purge and prime circuit 24 is shown in FIGS. 2 and 3. The circuit 24 includes a purge/prime bulb 46 and fuel passages, valves and flow restrictors to control fuel flow in the circuit. A peripheral edge of the bulb 46 is trapped against the fuel pump body 28 by a retainer 48 which may be connected to the fuel pump body 28 by one or more screws 50, which may also couple the fuel pump body 28 to the main body 12. A purge/prime chamber 52 is defined between the interior of the bulb 46 and the fuel pump body 28. The pressure in the chamber 52 increases when the bulb 46 is actuated (e.g. depressed or compressed) to discharge fluids from the chamber 52, and the pressure in the chamber 52 decreases when the bulb 46 returns from its depressed to its normal state to draw fluid into the chamber 52. A two-way valve 54 controls the admission of fluids into the purge/prime chamber 52 and the discharge of fluids therefrom. In one form, the valve 54 may be a mushroom shaped valve having a stem 56 through which fluid may be discharged from the bulb chamber 52 and into a purge passage 58 (FIG. 3) that leads to a fuel tank, but which is closed to prevent fluids from entering the bulb chamber 52 through the purge passage 58. The valve 54 may also have a flexible head 60 the periphery of which is displaced by a reduced pressure in the chamber 52 caused by expansion of the bulb 46 as the bulb returns to its uncompressed or normal state to permit fluid flow into the chamber 52 through an inlet passage 62. The head 60 is pressed against the pump body 28 when the bulb 46 is depressed to close the inlet passage 62 and prevent fluid from being discharged from the chamber 52 through the inlet passage 62. In this way, fluids may be drawn through the carburetor 10, into the chamber 52, and then discharged from the chamber 52 to the purge passage 58 to purge the carburetor 10 of stale fuel and/or vapors. This pumping action may also draw fresh fuel into the carburetor fuel passages to facilitate starting and initial operation of the engine.

In addition to the purge passage 58 through which fluids are routed to the fuel tank, the purge and prime circuit 24 may also include a priming passage 64 (shown in FIGS. 2 and 3). The priming passage 64 communicates with the bulb chamber 52 and the main bore 14 of the carburetor 10 to provide a charge of fuel into the main bore when liquid fuel is present in the chamber 52 and the bulb 46 is depressed. In more detail, in the example shown in FIG. 2, the priming passage 64 may have a first end 66 that is located outboard of the head 60 of the valve 54 so that flow through the priming passage 64 is not controlled by the valve 54. The priming passage 64 may extend through the fuel pump body 28, through the fuel pump diaphragm 22, through a gasket 68 located between the fuel pump diaphragm 22 and the pump body 28, and into the main body 12 where its second end 70 (FIG. 3) either terminates directly into the main bore 14 or in a passage or chamber that leads to the main bore. The priming passage 64 may provide fuel to the main bore 14 anywhere along the length of the main bore. Where the main bore 14 includes a reduced diameter neck or venturi portion, the priming passage 64 may provide fuel downstream of the venturi, although upstream of the venturi is also possible. Likewise, the priming passage 64 may provide fuel downstream of a throttle valve 72 of the carburetor 10, although upstream of the throttle valve 72, or in the same region as the throttle valve are also possible.

The priming passage 64 may be separate from and not communicated with the purge passage 58, although the priming passage 64 could branch off of the purge passage 58 rather than directly open into the bulb chamber 52. A check valve 74 may be provided, if desired, in the priming passage 64 to prevent fluids from being drawn into the chamber 52 through the priming passage 64. That is, the check valve 74 may ensure that fluids flow only into the main bore 14 from the priming passage 64 and not out of the main bore 14 into the priming passage 64.

Repeated actuations (e.g. depressions) of the bulb 46 will purge stale fluids from the carburetor 10 and prime the carburetor with fresh, liquid fuel. Some of the fresh liquid fuel may be discharged from the bulb chamber 52, through the priming passage 64 and into one or more reservoir passages and/or into the main bore 14 of the carburetor 10 to provide a charge of fuel prior to starting the engine, to facilitate starting the engine.

In carburetors for small engines, only a very small amount of fuel is needed to facilitate starting and initial engine operation. If too much fuel is provided from the priming passage 64 the engine may become "flooded" which basically means that too rich of a fuel and air mixture is provided to the engine and the engine cannot readily be started. In at least some implementations of carburetors designed for use with engines between 25 cc and 35 cc, a priming volume of fuel of between about 0.4 ml to 0.85 ml has been found sufficient, although that volume may be different for different carburetors and/or in use with different engines, and the innovations disclosed herein can be used with much larger engines. This volume of fuel may be fed to a reservoir passage or internal volume within the carburetor that is communicated with the main bore 14 and/or at least some of the fuel may be discharged into the main bore during priming.

Forming a small enough fuel passage within the carburetor, or even within a separate nozzle or jet that is installed into the carburetor, to prevent too much fuel flow during priming is difficult without resorting to expensive processing techniques like laser forming or etching. In some implementations, the carburetor body 12 is formed from cast aluminum (or other metal) and the smallest practical hole/passage that can be formed in mass production is about 0.46 mm in diameter. While slightly smaller holes/passages can be drilled in the metal body, it is difficult to reliably do so in mass production. Even a hole/passage as small as 0.46 mm in diameter permits a higher than desired fuel flow rate for the purging and priming operation with such carburetors. Accordingly, smaller holes/passages have been provided at greater cost by laser forming or acid etching. One currently suitable hole size is about 0.1 mm in diameter, which provides a flow rate on a Solex flow meter of about 480 to 495 (with a 0.27 mm jet), which may equate to about a 4.5 to 7 liters/hour air flow rate at an air pressure of 20 kPa. Hence, a very small diameter opening is needed in at least some implementations of the carburetor.

As shown in FIG. 2, to control the flow rate of fuel that flows through the priming passage 64, a flow restrictor 80 may be provided in the priming passage 64. Instead of a jet or nozzle with a small opening defining the flow restriction, the flow restrictor may be a solid body around which the fuel must flow. With the flow restrictor installed, the minimum effective flow area through the passage is the cross-sectional area of the passage minus the cross sectional area of the flow restrictor. By reducing the fuel flow rate through the priming passage 64, only a desired flow rate of fuel will be available to the main bore for starting and initial engine operation. Also, most of the fluid discharged from the bulb chamber 52 will be routed to the fuel tank through the purge passage 58 which has greater diameter or flow area compared to the restriction, and only a desired amount of fuel will flow into the main bore 14 from the priming passage 64.

The flow restrictor enables use of a larger diameter opening/passage 64 which can be readily machined in a production run of carburetors. For example, the passage may have a diameter of 0.46 mm or greater while the flow restrictor reduces the effective flow area of the passage to a desired level, and may be between 0.05 and 0.4 mm in diameter, and in some applications between 0.05 and 0.2 mm. In one experimental setup, a 0.46 mm diameter hole with a flow restrictor having a diameter of 0.41 mm provided a Solex air flow of 485 and an air flow rate of 6.8 liters per hour under an air pressure of 20 kPa. In another experimental setup, a 1.05 mm diameter hole with a flow restrictor having a diameter of 1.03 mm provided an air flow rate of 4.5 liters/hour under an air pressure of 20 kPa. In at least some implementations, the priming passage is at least 0.4 mm in diameter and the total flow area between the flow restrictor and the priming passage is less than 0.12 $mm^2$, and may be less than 0.08 $mm^2$ such as between 0.002 $mm^2$ and 0.08 $mm^2$ in at least some implementations.

Figure 11:
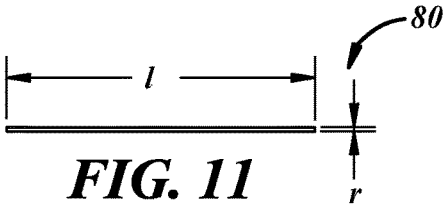
FIG. 11 is a side view of a flow restrictor.

As shown in FIGS. 2, 7-9 and 11, the flow restrictor 80 may be an elongated member, such as a thin, solid wire, that is inserted into the priming passage 64 and may extend through all or a significant portion of the axial length of the passage. The flow restrictor may be cylindrical or any other desired shape and it may be straight, bent or curved, wavy, spiral or in any desired form. In at least some implementations, the priming passage 64 may include a reduced diameter section 82 and the flow restrictor is designed to be received in and, in many instances, completely through the reduced diameter section of the passage 64. Accordingly, the maximum restriction to fluid flow through the passage 64 occurs in the area of the flow restrictor 80, and between the flow restrictor 80 and the wall defining the passage 64, which is a smaller flow area than provided by the passage (even in the area of the reduced diameter section) without the flow restrictor therein. As shown in FIG. 11, the flow restrictor 80 may have an axial length (l) greater than its maximum radial dimension (r) (where, when the flow restrictor is round in cross-section, its maximum radial dimension is equal to its diameter). In different terms, the flow restrictor 80 has a length (l) greater than its width or thickness. In at least some implementations, a ratio of the length (l) of the flow restrictor 80 to its maximum radial dimension (r) (or width/thickness) is greater than 4, and a ratio of the length (l) of the flow restrictor 80 to its perimeter may be greater than 2.

To secure the flow restrictor 80 in the carburetor 10, one or both ends of the flow restrictor 80 may be deformed, such as by being bent or crimped to prevent that end from unintentionally passing through or being removed from the passage 64. The flow restrictor 80 may be of any material suitable for use in the carburetor and with the fuel flowing through the carburetor, such as various metals (e.g. stainless steel, copper, brass), plastics or composites. The flow restrictor 80 may be round in cross-section or have any other desired shape to provide a desired flow restriction when inserted into a hole or passage.

The amount of priming fuel provided during priming is a function of the number of times the bulb 46 is actuated, and the volume of the bulb compared to the volume of the passages through which fluid is moved by the bulb. Although not required in every implementation, the effective flow rate of the passage 64 with the flow restrictor 80 therein may be less than the minimum flow rate through a passage machined in a production run of carburetors. Conventional jets or nozzles for carburetors are drilled or machined parts that have a flow area or opening diameter of at least 0.3 mm. Accordingly, much smaller restrictions can be economically achieved by use of the flow restrictor as described herein. Of course, different flow rates can be achieved with the same size passage 64 by simply substituting a differently sized flow restrictor 80.

Figure 4:
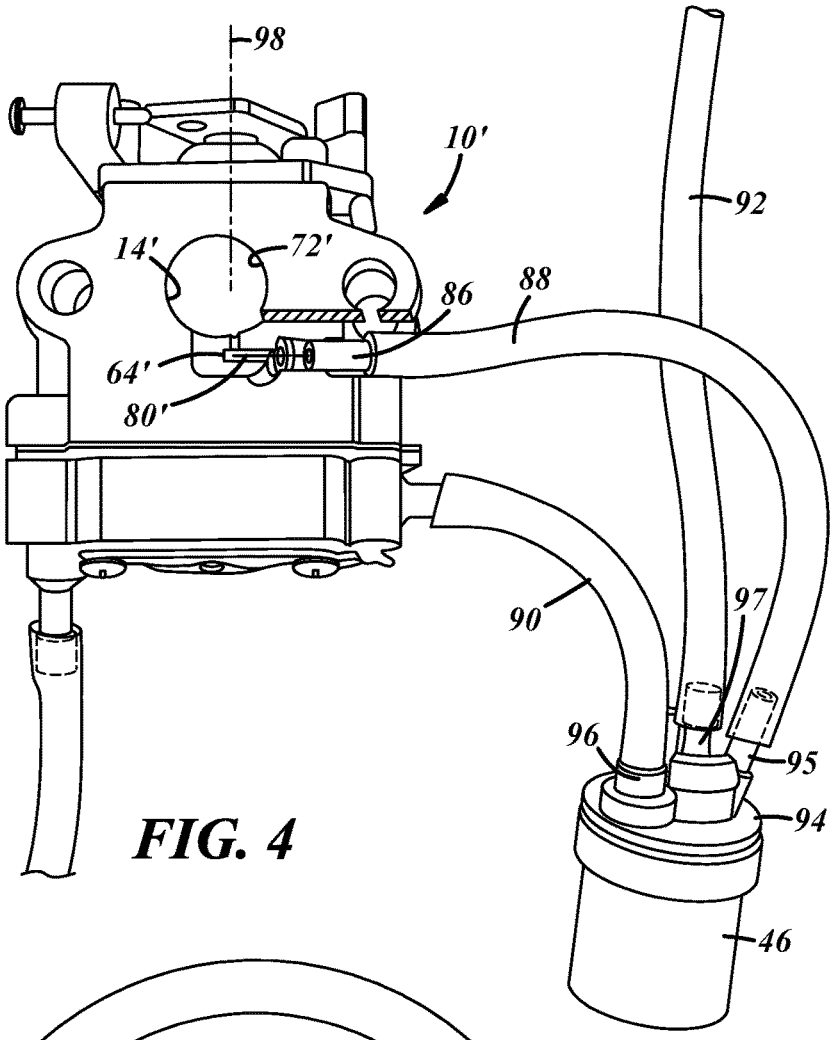
FIG. 4 is a perspective view of a carburetor having a remotely located purge prime pump.

In addition to the priming passage 64 shown in FIGS. 2 and 3, the flow restrictor 80 may be positioned elsewhere in the carburetor 10, and used in different types of carburetors. FIG. 4 illustrates a carburetor having a remotely located purge/prime pump, where remotely located means that the purge/prime bulb 46 is not carried directly by the carburetor body and is instead coupled thereto by one or more fluid conduits or tubes.

Figure 5:
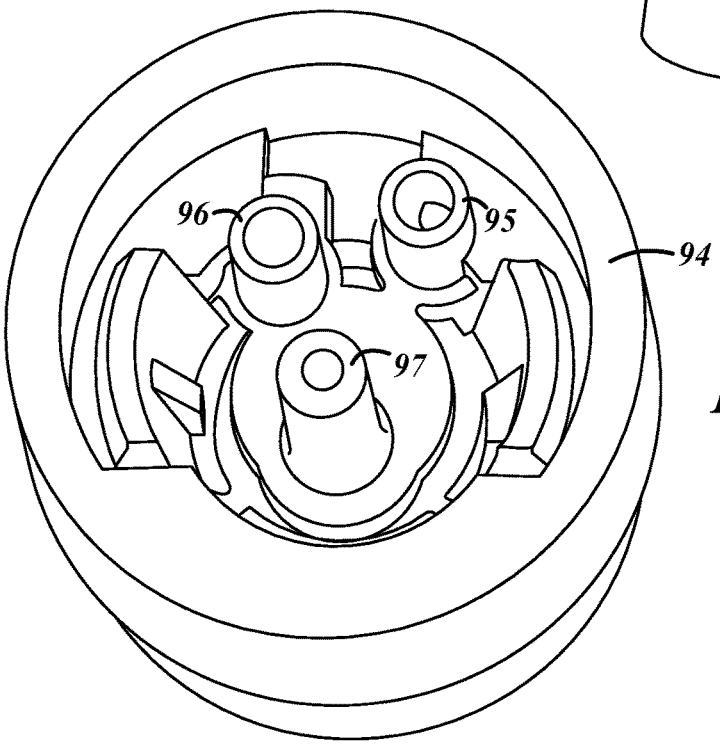
FIG. 5 is a bottom perspective view of a purge prime pump body.
Figure 6:
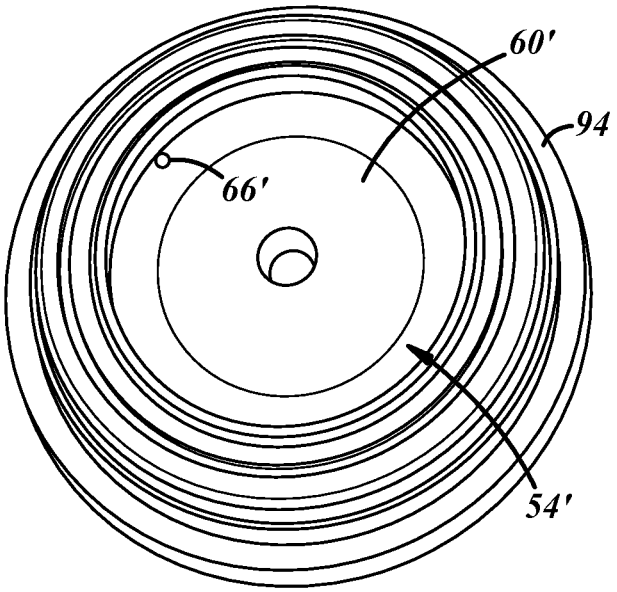
FIG. 6 is a top perspective view of the purge prime pump body with an actuating bulb removed.

As shown in FIG. 4, a hose fitting 86 carried by the carburetor may receive an end of a hose 88 defining part of the priming passage 62 in this implementation. In addition to the hose 88, a hose 90 routes purge flow from the carburetor 10 to the purge and prime bulb 46, and a hose 92 routes the purge flow from the purge/prime bulb 46 to the fuel tank. As shown in FIGS. 4 and 5, the bulb may be carried by a base 94 having fittings 95, 96, 97 and associated passages through the base 94 for each hose 88, 90, 92, defining part of the passages for the various fluid flows into and out of the bulb chamber 52. FIG. 6 shows the inlet end 66' of the priming passage and the head 60' of the valve 54'. As shown, the carburetor 10' is a rotary throttle valve carburetor having a cylindrical throttle valve 72' rotated about an axis 98 perpendicular to the main bore 14' to vary the alignment of a hole through the throttle valve with the main bore, as is known in the art. Of course, the carburetor 10' may be the same type as the carburetor 10 previously described. In this example, the flow restrictor 80' may be inserted into the priming passage 64' downstream of the hose fitting 86.

Figure 7:
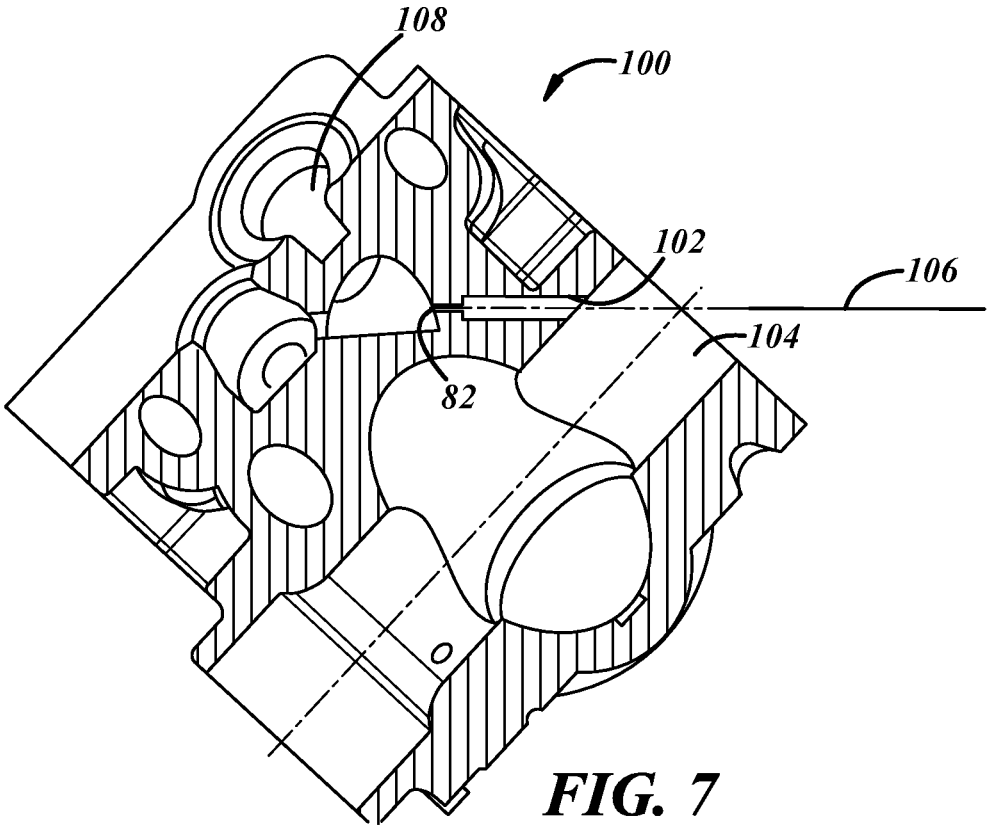
FIG. 7 is an exploded sectional view of a carburetor body and a flow restrictor.
Figure 8:
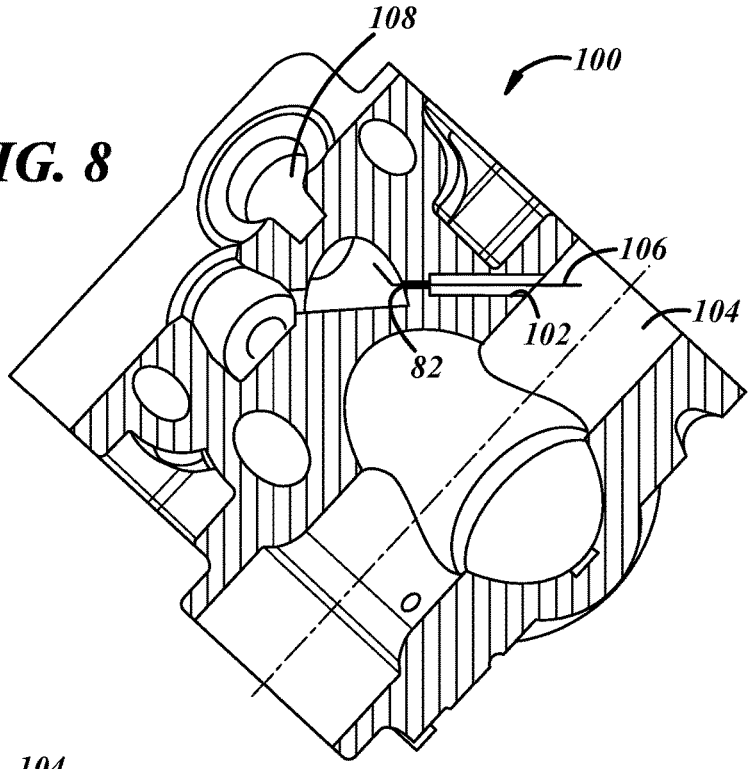
FIG. 8 is an assembled sectional view of the carburetor body of FIG. 7 showing the flow restrictor installed in a portion of a passage of the body.

FIGS. 7 and 8 show a carburetor body 100 having a priming passage 102 leading to and intersecting a main bore 104 and having a flow restrictor 106 carried therein, and shown in this implementation as extending therethrough. One end of the flow restrictor 106 may be accessed via and may extend outwardly into the main bore 104. The other end of the flow restrictor 106 may be accessed via and extend outwardly into a cross-drilled or intersecting passage 108 which may subsequently be plugged. A portion of the flow restrictor 106, such as one or both ends, may be deformed (e.g. bent) to maintain the flow restrictor within the priming passage 102 and prevent unintentional removal of the flow restrictor from the passage.

Figure 9:
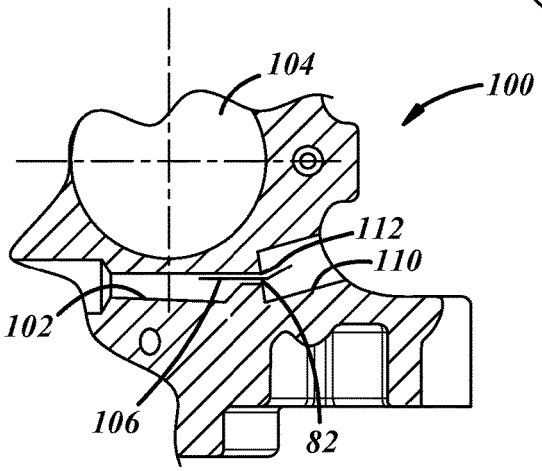
FIG. 9 is a fragmentary sectional view of a portion of a carburetor body showing a flow restrictor in a portion of a priming passage.

FIG. 9 shows a different portion of the priming passage 102 that is upstream of the portion of the priming passage 102 shown in FIGS. 7 and 8. The portion of the priming passage 102 shown in FIG. 9 is upstream of an internal reservoir (e.g. cavity or passage) into which priming fuel is provided before being discharged into the main bore, and the portion of the passage 102 shown in FIGS. 7 and 8 is downstream of the internal reservoir. Accordingly, the maximum restriction in the priming passage 102 may be provided at different locations or in multiple locations, as desired. This portion of the passage 102 includes or leads to a bore 110 in which the hose fitting for a purge and prime pump (like hose fitting 86 in the embodiment of FIG. 4) is received and a reduced diameter section 112 downstream of the bore 110. The flow restrictor 106 may be inserted through the bore 110 and into the reduced diameter section 112 to provide a restricted fuel flow rate in a portion of the priming passage 102 that is upstream from that shown in FIGS. 7 and 8 and also accessible from outside of the carburetor body 100 during assembly of the carburetor. In assembly, the end of the flow restrictor 106 adjacent to the hose fitting bore 110 may be deformed to prevent that end from entering the reduced diameter section 112, and the flow restrictor 106 may be of a length such that its deformed end will engage the hose fitting in the bore 110 while the opposite end of the flow restrictor is still located on the other side or at least within the reduced diameter section 112. In this way, the position of the flow restrictor 106 within the reduced diameter section 112 is maintained without deforming both ends of the flow restrictor.

When more-or-less loosely inserted into a passage, the flow restrictor 80, 80', 106 may move relative to the passage. This may change the fuel flow characteristics through the passage, but this has been found to be acceptable within the size ranges contemplated herein, and for a priming passage 64, 64', 102 where certain variations in fuel flow rate can be tolerated. With the flow restrictor able to move within the passage, contaminants are less likely to become trapped between the flow restrictor and the wall defining the passage in which the flow restrictor is received. This is because the maximum distance between the flow restrictor and the wall changes as the flow restrictor moves, and that maximum distance is greater when the flow restrictor is not centered within the passage.

Figure 10:
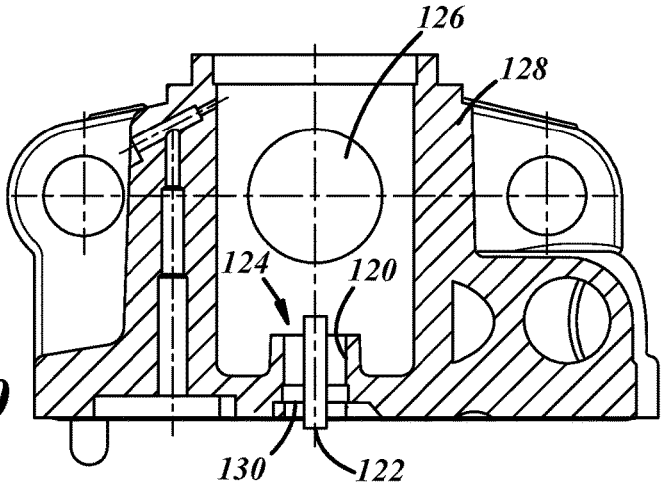
FIG. 10 is a sectional view of a carburetor body showing a flow restrictor in a fuel nozzle of the carburetor.

As shown in FIG. 10, a larger opening 120 with a flow restrictor 122 therein may be used to define and regulate the flow rate out of the main fuel nozzle 124 through which fuel enters the main bore 126 during high speed or high load engine operation. The main nozzle 124 can be formed by a drilled or cast hole 120 in the carburetor body 128, and different flow rates may be achieved for different engines by use of a differently sized flow restrictors 122. The flow restrictor 122 may be held in place in a desired location within the hole, such as by a retainer or clip 130 of a desired design. This may keep the flow restrictors 122 in a production run of carburetors in a similar position to ensure similar performance, as the maximum flow area between the hole and flow restrictor will vary as the position of the flow restrictor varies within the hole (the total flow area will remain the same, but the maximum distance between the periphery of the flow restrictor and the wall forming the hole will vary). Use of flow restrictors may reduce part count and cost to manufacture and assemble the carburetors for different engines, and/or improve calibration of carburetors in a production run by fine tuning the size of the flow restrictors to accommodate manufacturing tolerances in the hole that, with the flow restrictor, defines the main nozzle.

Further, while shown above as being received in a fuel passage of the carburetor, a flow restrictor may also be provided in the same way in an air passage of the carburetor. Air passages in carburetors are known and, for example, may communicate engine pressure pulses to a carburetor diaphragm, provide a vent for the carburetor, and/or supply a flow of air to a desired area of the carburetor, such as an air-bleed into the main bore to enlean the fuel and air mixture during at least some engine operating conditions.

While the forms of the invention herein disclosed constitute presently preferred embodiments, many others are possible. For example, while the carburetors shown include butterfly type throttle valves and rotary valve carburetors, the purge and priming assembly, priming passage, flow restrictor, as well as other features, can be used with other types of carburetors including float bowl carburetors which may be used with engines of different sizes, such as but not limited to, engines for lawn mowers, snow blowers and garden tractors. Of course, carburetors for even larger engines could utilize the concepts and innovations set forth herein. It is not intended herein to mention all the possible equivalent forms or ramifications of the invention. It is understood that the terms used herein are merely descriptive, rather than limiting, and that various changes may be made without departing from the spirit or scope of the invention.

The invention claimed is:

1. A carburetor, comprising:

a body having a main bore through which a fuel and air mixture is discharged from the carburetor for use by an engine and a priming passage communicated with the main bore;

a pump that moves fluid into the priming passage; and a flow restrictor received within at least a portion of the priming passage to reduce the minimum effective flow area of the priming passage, the flow restrictor comprising a body received at least partially within the priming passage so that fluid flows around the flow restrictor and between the structure defining the priming passage and the flow restrictor.

2. The carburetor of claim 1 wherein the flow restrictor defines the maximum restriction to flow in the priming passage and the flow restrictor has a length to thickness ratio of at least 4.

3. The carburetor of claim 1 wherein the flow restrictor defines the maximum restriction to flow in the priming passage and the flow restrictor has a length to perimeter ratio of at least 2.

4. A carburetor, comprising:

a body having a main bore through which a fuel and air mixture is discharged from the carburetor for use by an engine and a priming passage communicated with the main bore;

a pump that moves fluid into the priming passage; and a flow restrictor received within at least a portion of the priming passage to reduce the minimum effective flow area of the priming passage, the flow restrictor comprising a wire received at least partially within the priming passage so that fluid flows around the flow restrictor and between the structure defining the priming passage and the flow restrictor.

5. The carburetor of claim 4 wherein the total flow area is less than 0.08 $mm^2$.

6. A carburetor, comprising:

a body having a main bore through which a fuel and air mixture is discharged from the carburetor for use by an engine and a priming passage communicated with the main bore;

a pump that moves fluid into the priming passage;

a flow restrictor received within at least a portion of the priming passage to reduce the minimum effective flow area of the priming passage, the flow restrictor comprising a body received at least partially within the priming passage so that fluid flows around the flow restrictor and between the structure defining the priming passage and the flow restrictor; and the priming passage is at least 0.4 mm in diameter and the total flow area between the flow restrictor and the priming passage is less than 0.12 $mm^2$.

7. The carburetor of claim 6 wherein the priming passage has a reduced diameter section and the flow restrictor extends completely through the reduced diameter section.

8. The carburetor of claim 6 which also includes at least one passage intersecting with the priming passage and providing access to an end of the flow restrictor so that the end of the flow restrictor may be deformed to inhibit unintended removal of the flow restrictor.

9. The carburetor of claim 8 wherein the passage intersecting with the priming passage is the main bore and a portion of the flow restrictor extends into the main bore.

10. The carburetor of claim 6 wherein the flow restrictor defines the maximum restriction to flow in the priming passage and the flow restrictor has a length to thickness ratio of at least 4.

11. The carburetor of claim 6 wherein the flow restrictor defines the maximum restriction to flow in the priming passage and the flow restrictor has a length to perimeter ratio of at least 2.

12. The carburetor of claim 6 wherein the priming passage has a reduced diameter section and the flow restrictor extends completely through the reduced diameter section.

13. The carburetor of claim 6 which also includes at least one passage intersecting with the priming passage and providing access to an end of the flow restrictor and the end of the flow restrictor is deformed to inhibit unintended removal of the flow restrictor.

14. The carburetor of claim 13 wherein the passage intersecting with the priming passage is the main bore and a portion of the flow restrictor extends into the main bore.

15. A carburetor, comprising:

a body having a main bore through which air flows and into which fuel is admitted to provide a fuel and air mixture to an engine and a passage through which fluid flows; and a flow restrictor provided through at least a portion of the passage to reduce the minimum effective flow area of the passage, the flow restrictor comprising a body received at least partially within the passage so that fluid flows around the flow restrictor and between the portion of the body defining the passage and the flow restrictor, the priming passage is at least 0.4 mm in diameter and the total flow area between the flow restrictor and the priming passage is less than 0.12 $mm^2$.

16. The carburetor of claim 15 wherein air flows through the passage.

17. The carburetor of claim 15 wherein fuel flows through the passage.

18. The carburetor of claim 15 wherein the passage defines a fuel nozzle of the carburetor that opens into the main bore to provide fuel into the main bore.

19. The carburetor of claim 15 wherein the flow restrictor is defined by a wire.

* * * * *